US005259208A

United States Patent [19]

Mizuno

[11] Patent Number: 5,259,208

[45] Date of Patent: Nov. 9, 1993

[54] YARN CARRIER

[75] Inventor: Satoshi Mizuno, Gifu, Japan

[73] Assignee: Oritake Co. Ltd., Gifu, Japan

[21] Appl. No.: 960,097

[22] Filed: Oct. 13, 1992

[30] Foreign Application Priority Data

Oct. 14, 1991 [JP] Japan ..... 3-264877

[51] Int. Cl.[5] ..... D04B 15/54

[52] U.S. Cl. ..... 66/125 R; 66/141

[58] Field of Search ..... 66/125 R, 125 B, 131, 66/141

[56] References Cited

U.S. PATENT DOCUMENTS

| | | | |
|---|---|---|---|
| 351,624 | 10/1886 | Converse | 66/141 |
| 374,196 | 12/1887 | Marshall | 66/141 |
| 426,761 | 4/1890 | Brinton et al. | 66/141 |
| 445,690 | 3/1891 | Branson | 66/141 |
| 1,479,543 | 1/1924 | Howie et al. | 66/141 |
| 2,406,775 | 9/1946 | Killian | 66/125 R |
| 3,584,478 | 6/1971 | Philip | 66/141 X |
| 4,364,246 | 12/1982 | Leins et al. | 66/125 R X |

FOREIGN PATENT DOCUMENTS

| | | | |
|---|---|---|---|
| 1300047 | 3/1987 | U.S.S.R. | 66/141 |

OTHER PUBLICATIONS

Brochure of Inamoto Company.

*Primary Examiner*—Clifford D. Crowder
*Assistant Examiner*—John J. Calvert
*Attorney, Agent, or Firm*—Steven J. Weissburg

[57] ABSTRACT

A yarn carrier for a circular knitting machine has a swing member swingably attached to a support member and a spring between the swing member and the support member so that if an accidentally closed latch of a latch needle accidentally hits the swing member, such as may occur during unintended stopping of the machine, the swing member is pushed rearward, away from the latch needles, to effectively cushion the contact pressure and protect the latch needle from suffering physical damage. The swing member may also have two depressions, one to provide clearance for the latch needles when moving relative the swing member in a generally vertical direction as the thread is engaged, and one to provide clearance for the latch needles when moving in a generally horizontal direction, after the thread has been engaged and the latch needle is moving away from the support member.

6 Claims, 10 Drawing Sheets

YARN CARRIER

BACKGROUND OF THE INVENTION

This invention relates to a yarn carrier for a circular knitting machine which uses latch needles and more particularly relates to a yarn carrier for a circular knitting machine for effectively preventing the latch needles from suffering physical damage which is often caused by operational trouble such as yarn breakage.

A conventional latch needle catches a yarn with its hook (as shown in FIG. 9). however, occasionally the hook fails to catch the yarn completely, often catching the yarn only by a portion of the yarn.

In order to prevent such a failure from occurring a yarn carrier having a depression (as shown in FIG. 8) provided above its yarn feeder has been proposed so that the hook of the latch needle may catch the yarn in a securer manner.

A yarn carrier provided with such a depression thereon provides the hook of a latch needle with a securer catching of a yarn, however, it is not without a weakness. When operational trouble such as breakage of a yarn takes place the motive power of the machine is cut off to minimize the trouble, however, the latch needles of the circular knitting machine cannot stop moving instantly but keep on moving for sometime due to the force of inertia causing some closed latches of the latch needles to hit the front surface of the yarn carrier, which occasionally results in damaging the latch needles.

SUMMARY OF THE INVENTION

According to the present invention, a yarn carrier for a circular knitting machine provides a secure catching of a yarn and prevents the latch needles from suffering physical damage in case of operational trouble such as yarn breakage.

A yarn carrier for a circular knitting machine according to the present invention comprises a swing member which swings like a door and a spring means having an elastic component provided on the rear surface of said swing member, wherein said swing member is made to retreat when the closed latch of a latch needle hits said swing member on the front, cushioning the physical shock, and thus protecting the latch from suffering damage.

The yarn carrier for a circular knitting machine according to the present invention further comprises a slanting surface provided on the front surface of said swing member so that at the time of operational malfunction such as breakage of a yarn said latch in its closed position may smoothly slide forward on said slanting surface of said swing member aided by the sloping effect of said slanting surface and may escape damage thereonto which said latch otherwise may suffer.

Accordingly the principal object of the present invention is to provide a yarn carrier for a circular knitting machine which can effectively prevent physical damage to the latch needles from occurring in case of operational trouble by providing the yarn carrier with a swing member having a slanting surface and a spring means on the rear surface of said swing member, so that said swing member can retreat to cushion the contact pressure caused by accidentally contacting with the latch needles.

This feature of the present invention will be more fully understood from the following detailed description which should be read in conjunction with the several figures in which corresponding reference numerals refer to corresponding parts throughout the several views.

DESCRIPTION OF THE PREFERRED EMBODIMENT

Figure 1:
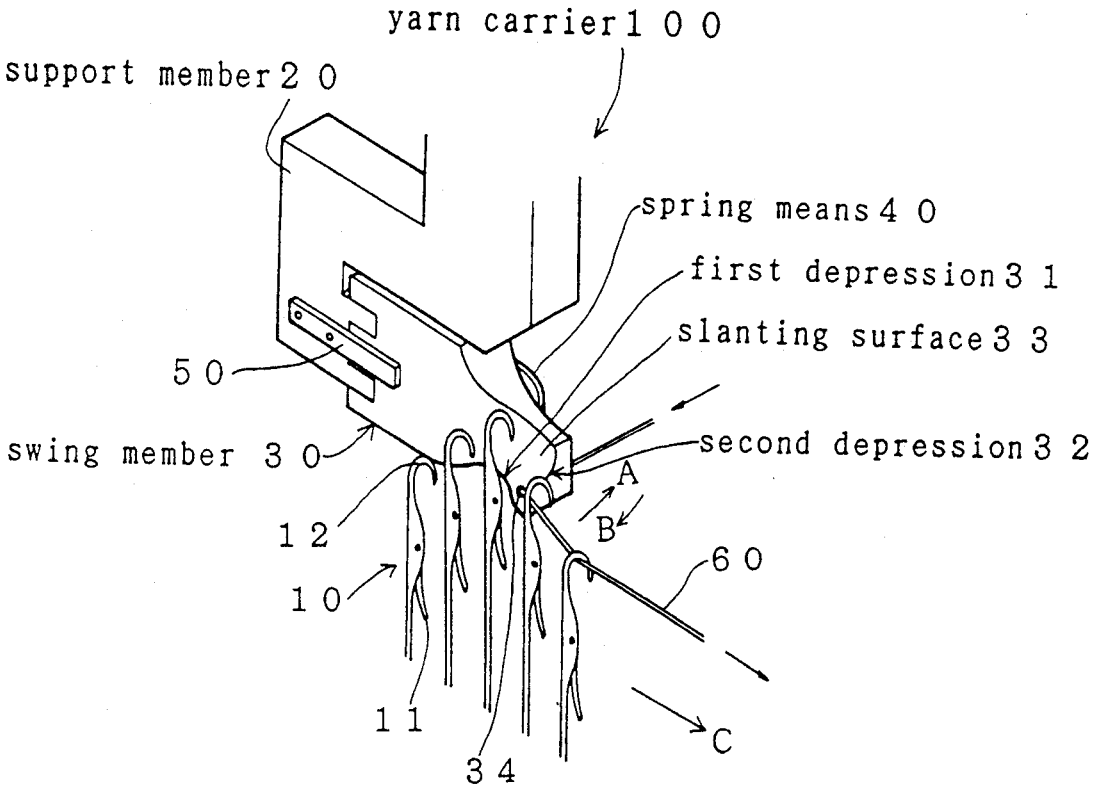
FIG. 1 is a partial perspective view of a yarn carrier according to the present invention.

At the outset the present invention is described in its broadest overall aspects with a more detailed description following.

In its broadest overall aspects the present invention provides a yarn carrier for a circular knitting machine which can prevent physical damage to the latch needles from occurring in case of operational trouble such as yarn breakage by providing the yarn carrier with a swing member having depressions and a slanting surface within one of said depressions and also by providing the swing member with a spring means on the rear surface of said swing member.

The yarn carrier 100 comprises a support member 20, a swing member 30 and a spring means 40, wherein said spring means 40 is provided on the rear surface of said swing member 30.

Said swing member 30 comprises a first depression 31 and a second depression 32, wherein said first depression 31 is provided with a slanting surface 33. Said swing member 30 retreats smoothly by way of depressing said spring means 40 when said swing member 30 is hit by a closed latch needle 10 in an accident.

Said first depression 31 provides the hook 12 of a latch needle 10 with clearance so that said hook 12 can move upward without hitting said swing member 30, while said second depression 32 provides said hook 12 with clearance so that said hook 12 can move forward without hitting said swing member 30.

Said slanting surface 33 provides the latch 11 of said latch needle 10 with an aid for smooth and soft forward sliding on said slanting surface 33 in case of the abrupt stoppage of the motive power of the circular knitting machine under operational trouble such as breakage of a yarn 60.

The present invention is described in more detail hereafter.

Figure 5:
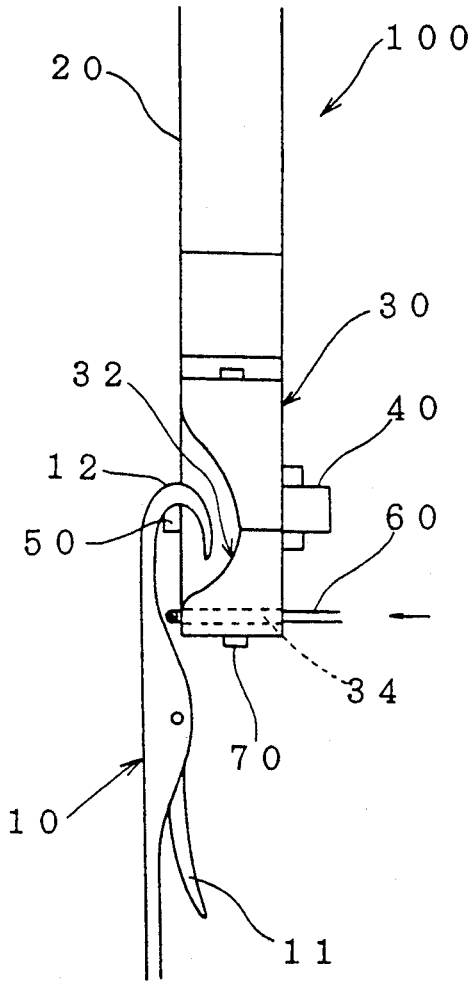
FIG. 5 is a partial right-side view of the yarn carrier of FIG. 1 showing a relationship between the yarn carrier and a latch needle whose latch is open.

As shown in FIG. 1 and FIG. 5, a yarn carrier 100 for a circular knitting machine according to the present invention comprises a first depression 31 and a second depression 32 in the swing member 30. As a latch needle 10 moves upward while it is moving in the direction indicated by arrow C, the hook 12 of said latch needle 10 makes corresponding movements through said first depression 31 and then through said second depression 32 and securely catches a yarn 60 which is coming out of the yarn feeder 34 immediately after said hook 12 cleared said second depression 32.

Figure 6:
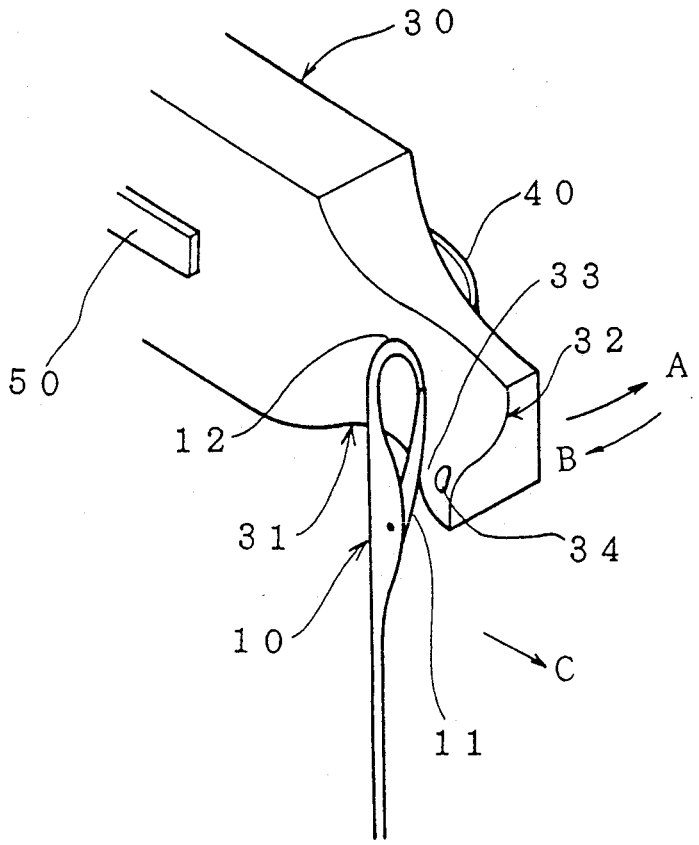
FIG. 6 is an enlarged partial perspective view of the yarn carrier of FIG. 1 showing a relationship between the yarn carrier and a latch needle whose latch is closed.
Figure 7:
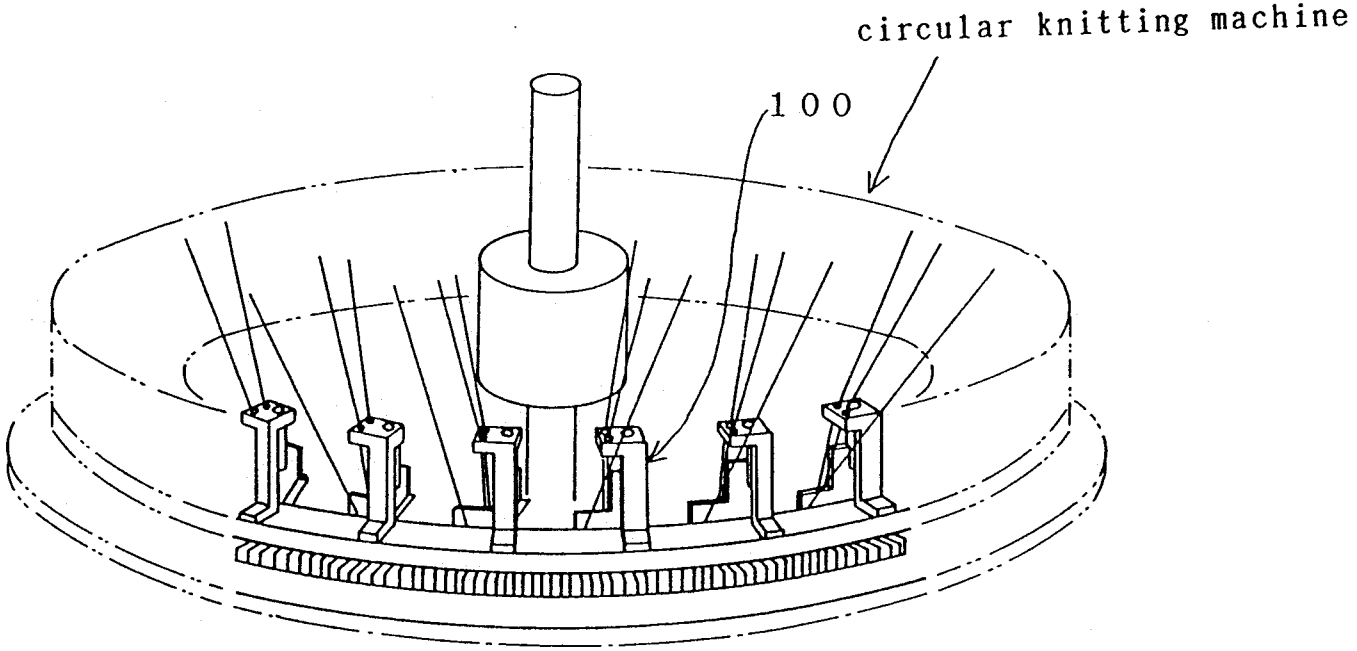
FIG. 7 is a perspective view of a principal part of a circular knitting machine showing how the yarn carriers of the present invention are incorporated.
Figure 8:
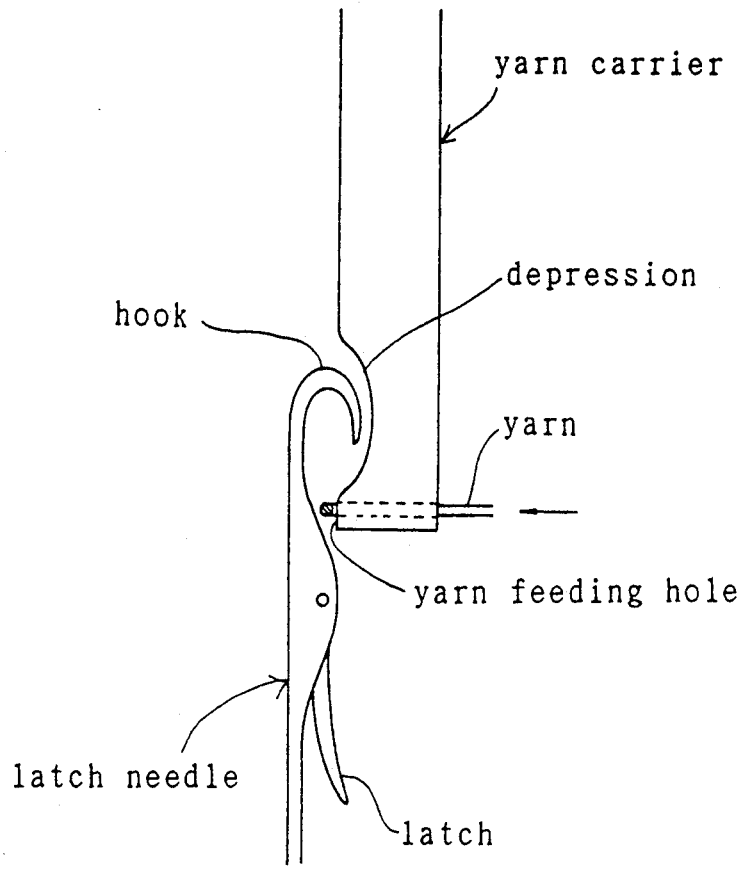
Fig. 8 (PRIOR ART)
FIG. 8 is a partial side view of a conventional yarn carrier showing a relationship between the yarn carrier and a latch needle.
Figure 9:
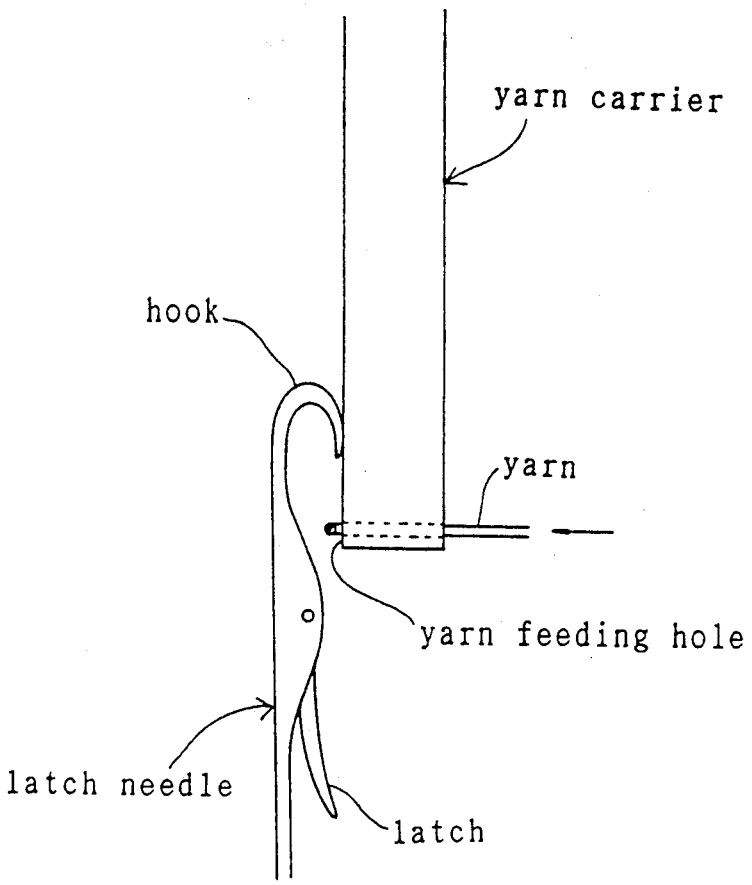
Fig. 9 (PRIOR ART)
FIG. 9 is a partial side view of another conventional yarn carrier showing a relationship between the yarn carrier and a latch needle.

In case of operational trouble such as the abrupt cut-off of the motive power of the circular knitting machine which is often caused by breakage of a yarn 60, the latch needles 10 of the circular knitting machine keep on moving due to the force of inertia. Some of their latches 11 are kept closed as shown in FIG. 6, since the opening of the latches 11 is not perfectly performed due to the accident. Such latch needles 10 keep moving in the direction of arrow C with their closed latches 11 softly sliding on said slanting surface 33 of said first depression 31.

Concurrently, said swing member 30 swingably secured to said support member 20 like a door smoothly retreats in the direction indicated by arrow A as shown in FIG. 1 and escapes most of the pressure incurred from the contact with said closed latch 11, cushioning the shock and leaving behind only minimum contact pressure thereon and on said latch 11 of said needle 10. Said latch needle 10 therefore can escape physical damage which it otherwise would often incur.

In order to provide a better escape from such damage onto said latch needle 10, it is preferred to provide the slanting angle of said slanting surface 33 on said swing member 30 with as small a slanting (inclination) angle as possible so long as said first depression 31 can provide its proper and appropriate function.

The configuration of said slanting surface 33 need not be flat. The shape of said slanting surface 33 may be a kind of curvature which can Provide better escape from said contact pressure.

Said swing member 30 returns to its normal position by means of said spring means 40 when the contact pressure given by said latch needle 10 no longer exists. Said spring means 40 can be anything so long as it can provide said swing member 30 with a necessary elastic and sufficiently smooth escape from the pressure caused by the contact with said latch needle 10 in case of an operational accident and so long as it sustains said swing member 30 at its normal position when there is no such contact pressure on said swing member 30.

The present invention is further explained in still more detail hereafter, however, it should not be considered a limitation to the scope of the present invention.

Figure 2:
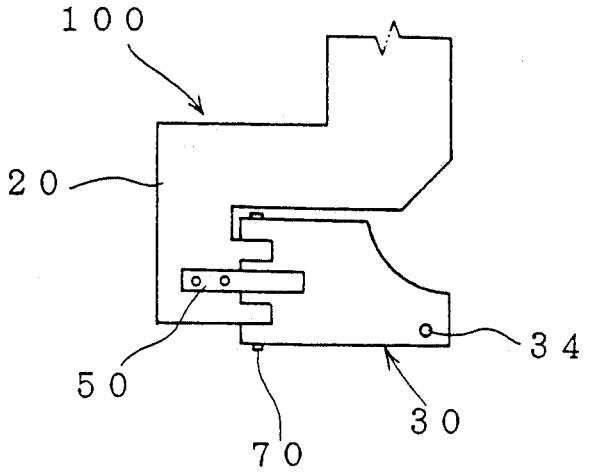
FIG. 2 is a partial front view of the yarn carrier of FIG. 1
Figure 3:
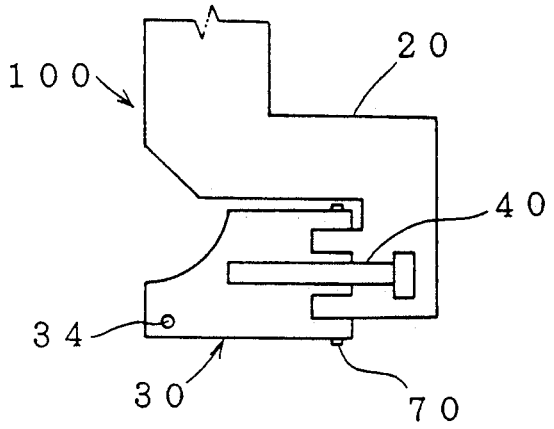
FIG. 3 is a partial rear view of the yarn carrier of FIG. 1.
Figure 4:
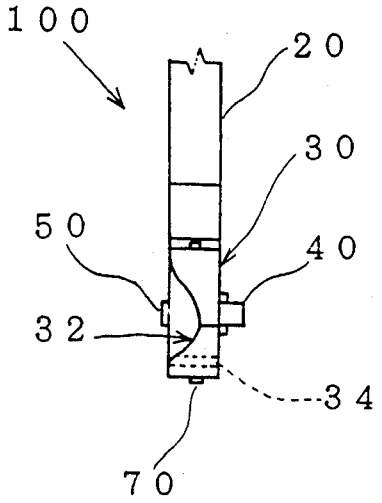
FIG. 4 is a partial right-side view of the yarn carrier of FIG. 1.
Figure 10:
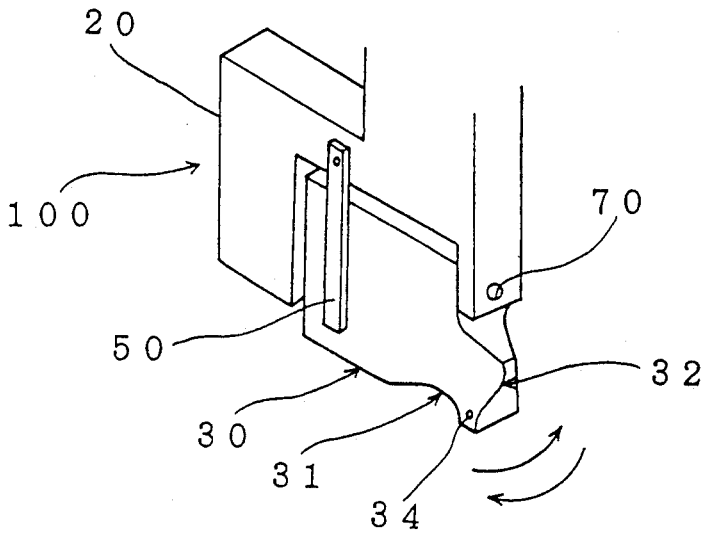
FIG. 10 is a partial perspective view of a yarn carrier showing another embodiment according to the present invention.

A yarn carrier 100 for use in a circular knitting machine according to the present invention comprises as shown in FIGS. 1 to 5 and 10 a support member 20 and a swing member 30, wherein said swing member 30 is swingably attached to said support member 20 like a door by means of a pin member 70. Said swing member 30 can be swingably attached to said support member 20 either vertically as shown in FIGS. 1 to 3 or horizontally as shown in FIG. 10, however, it can also be attached slantingly (not shown). A horizontal attachment is most preferred.

Said swing member 30 is provided with a first depression 31 and a second depression 32, wherein said first depression 31 provides upward clearance for the hook 12 of a latch needle 10, while said second depression 32 provides forward clearance for said hook 12 of said latch needle 10. Said first depression 31 is provided therein with a slanting surface 33 whose shape is a variation of curvature.

Said swing member 30 is also provided with a leaf spring means 40 on the rear surface thereof. Alternatively the spring means 40 to be used thereon may be any spring means, such as a coil spring. Said support member 20 is also provided with a stop member 50 on the front surface thereof so that said swing member 30 may not be pushed toward the front excessively by said spring means. Said stop member 50 is not an essential part of the present invention, however, it is desirable to use such a stop means 50 to securely protect latch needles 10 and also to stabilize and keep constant the position where the hooks 12 catch a yarn 60.

A yarn carrier 100 for use in a circular knitting machine comprising as such provides a reliable catching of the yarn 60 by the hooks 12 of the latch needles 10 and therefore promises a reliable and stable product quality.

A yarn carrier 100 for a circular knitting machine comprising as such also greatly reduces possibilities of causing damage to the latch needles 10 at the time of an accident in the operation of the circular knitting machine since the swing member 30 efficiently and effectively cushions such accidental contact pressure given by the closed latches 11 of the latch needles 10 by instantly retreating. The closed latches 11 softly slide on said slanting surface 33 of the front surface of said swing member 30 in case of an operational accident.

All alterations and modifications to the embodiments given above are to fall within the scope of the appended claims.

What is claimed is:

1. A yarn carrier for use in a circular knitting machine using latch needles, each with a hook and a latch, said yarn carrier comprising:

a. a support member;

b. a swing member swingably attached to said support member and having:

i. a needle surface which faces said needles, said needle surface comprising;

(a) a first depression to provide the hooks of the latch needles with clearance for a component of latch needle motion relative the swing member in a first direction, said first depression having a surface inclined from the deepest extent of said depression to an edge toward which said latch needles move relative to the swing member in a second direction substantially perpendicular to said first direction; and (b) a second depression to provide the hooks of the latch needles with clearance for a component of latch needle motion relative to said swing member in said second direction; and ii. a rear surface which faces away from said needles; and c. a spring means for springedly connecting said swing member and said support member.

2. A yarn carrier for use in a circular knitting machine according to claim 1, wherein said swing member is attached to said support member to permit swinging about a generally vertical axis.

3. A yarn carrier for use in a circular knitting machine according to claim 1, wherein said swing member is attached to said support member to permit swinging about a generally horizontal axis.

4. A yarn carrier for use in a circular knitting machine according to claim 1, wherein said spring means is stiff enough to maintain said swing member in place during normal operation of said knitting machine, and soft enough so that if a latch needle contacts the swing member, the swing member will swing away from the latch needle in the direction generally toward the swing member's rear surface,

5. A yarn carrier for use in a circular knitting machine according to claim 1, wherein said spring means is mounted on the rear surface of said swing member.

6. A yarn carrier for use in a circular knitting machine using latch needles, each with a hook and a latch, said yarn carrier comprising:

a. a support member;

b. a swing member swingably attached to said support member and having:

i. a needle surface which faces said needles; and ii. a rear surface which faces away from said needles; and c. a spring means for springedly connecting said swing member to said support member, wherein said spring means has an elastic component for maintaining said swing member in place during normal operation of said knitting machine, and if a latch needle contacts the swing member for allowing the swing member to swing away from the latch needle in the direction generally toward the rear surface of the swing member.

* * * * *